United States Patent [19]

Watkins et al.

[11] 3,998,033

[45] Dec. 21, 1976

[54] CLOVERLEAF BITLESS BRIDLE

[76] Inventors: L. Dale Watkins, 1015 Indiana Ave., Salt Lake City, Utah 84104; Lyman M. Watkins, 192 N. 6th East, Heber City, Utah 84032

[22] Filed: Mar. 6, 1975

[21] Appl. No.: 555,976

[52] U.S. Cl. ..... 54/6 R; 54/15

[51] Int. Cl.[2] ..... B68C 1/04

[58] Field of Search ..... 54/6, 7, 15, 24, 34, 54/85

[56] References Cited

UNITED STATES PATENTS

| | | | |
|---|---|---|---|
| 229,405 | 6/1880 | Hartmann | 54/15 |
| 952,610 | 3/1910 | Daly et al. | 54/6 R |
| 1,116,691 | 11/1914 | Gradberg | 54/6 R |
| 1,148,096 | 7/1915 | Klabo | 54/6 R |
| 1,333,474 | 3/1920 | De France | 54/15 |
| 1,478,958 | 12/1923 | Heien | 54/6 R |
| 1,530,450 | 3/1925 | White | 54/6 R |
| 2,186,350 | 1/1940 | Simon | 54/15 X |
| 2,342,449 | 2/1944 | Burgess | 54/15 X |
| 2,469,046 | 5/1949 | Laws | 54/6 R |

FOREIGN PATENTS OR APPLICATIONS

| | | | |
|---|---|---|---|
| 30,553 | 3/1919 | Norway | 54/6 R |

*Primary Examiner*—Peshock, Robert
*Assistant Examiner*—Jack Q. Lever
*Attorney, Agent, or Firm*—Criddle, Thorpe & Western

[57] ABSTRACT

A bitless bridle of the hackamore type which comprises the supporting headgear including a headstall, browband, throatlatch and centerpiece and also comprising a noseband and a chinband. The bitless bridle contains novel sidepieces having a cloverleaf configuration with an eyelet at each end, and in the same plane has oppositely protruding side eyelets near one end of the sidepiece, one eyelet being slightly closer to the end than the other. The cheekstrap portion of the headstall is attached to the end eyelet nearest the side eyelets. The noseband is fixedly connected to the side protruding eyelet closest the end eyelet and the centerpiece is attached to the noseband. The chinband is attached to the oppositely protruding lower spaced eyelet and the reins are attached to the end eyelet on the other end of the sidepiece. Slight pressure on the reins causes the sidepiece to rotate in an imaginary axis in the vicinity of the oppositely spaced eyelets forcing the noseband downwardly and against the nose of the horse. The chinband is forced upwardly against the jaw of the horse. The cheekband of the headstall is forced downwardly causing pressure behind the ears of the horse and an inward torque of the sidepieces causes pressure to be applied inward on the side of the jaws of the horse.

6 Claims, 2 Drawing Figures

CLOVERLEAF BITLESS BRIDLE

BACKGROUND OF THE INVENTION

This invention relates to a bridle for horses and more particularly to a bitless bridle of the hackamore type which applies pressure to the head of the horse in a novel manner in order to control the horse during training, riding, showing or other activities.

There are many situations in which the use of the conventional bit type bridle are highly disadvantageous. Many horses tend to chew the bit, have sore mouths, balk at the bit so that excessive pressure must be applied in order to obtain control, salivate excessively when the bit is in their mouth, or, in untrained and unbroken horses, misbehave and rear their heads so that the bit cannot be placed into their mouths.

For these reasons the hackamore type bridle is often used to break horses or to use on horses that have mouth problems, not allowing the use of a bit. It is also known that a bit in the horses mouth often causes cutting of the tongue, chipping of the teeth and other common bruises which are caused by jerking or by inexperienced riders.

Hackamore bridles having rigid sidepieces are known wherein applying pressure to the reins will cause a pivoting action to take place. The sidepieces are usually constructed such that an actual pivoting around a pivotal point takes place. These bridles are disadvantageous in that they apply pressure only to the nose and/or under the chin of the horse when there are other areas which are as sensitive and which also can aid in the control of the horses actions. Typical of these bridles are those illustrated in Gradberg U.S. Pat. No. 1,116,691; Reed U.S. Pat. No. 2,471,121; Newman U.S. Pat. No. 2,804,740; Sauter U.S. Pat. No. 2,931,154; and Stern et al. U.S. Pat. No. 3,458,971.

OBJECTS OF THE INVENTION

It is an object of this invention to provide a bitless bridle having novel sidepieces whereby pressure upon the reins is transmitted by the sidepieces to multiple points on the horses head. It is a further object of this invention to provide a bitless bridle wherein the sidepieces operate by pivotal means around the imaginary axis but which contains no moving parts and which will, when pressure is applied to the reins, manually exert pressure to the horse at the top of the head back of the horses ears, over the front of the horses nose, under the chin and inwardly on the sides of the jaw of the horse.

Another object of the invention is to provide a bitless bridle to be utilized for training means wherein pressure applied to the training rope attached to the chinband of the bridle will exert the same types of pressure as when pressure is applied to the reins.

It is a further object of the invention to provide a bitless bridle which will serve to control and train a horse in a more humane manner than utilizing a bit bridle.

It is still another object of this invention to provide a bitless bridle for use in quickly and efficiently training a horse.

These and other objects may be accomplished by means of the utilization of a novel sidepiece which for purposes of identification herein will be called a "cloverleaf" sidepiece. The sidepiece is a rigid elongated rod or bar which is preferably cylindrical in shape which terminates at either end with eyelets. Adjacent the eyelet at one end and protruding perpendicularly from the sidepiece are oppositely extending eyelets, one of which is slightly closer to the end eyelet than the other. All eyelets are in the same plane. The sidepieces are mounted to supporting headgear which comprises an adjustable throatlatch, a headstall terminating in cheek sidepieces, a browband terminating in passageways at each end through which the throatstrap and headstall passes and an adjustable centerpiece having passageways in one end through which the headstall and throatlatch pass and extending through an opening in the browband. The centerpiece is attached at the other end to the noseband. The end eyelet of the cloverleaf sidepiece adjacent the oppositely extending eyelets is attached to the adjustable cheekstrap on either side of the bridle in such a manner that the side eyelet closest the end is in an upward position. The noseband is fixedly attached to the outwardly extending eyelet on each sidepiece closest the end eyelet and the other outwardly extending eyelet is attached to the chinband. The sidepieces are of such a length that the eyelets at the other end are about even with the end of the horses mouth and the reins pass through and are attached to these eyelets.

When pressure in the form of a backward motion is applied on the reins each sidepiece will rotate around an imaginary axis in the vicinity of the eyelets containing the noseband and chinband. The nosepiece is forced down into firm contact over the nose of the horse exerting pressure on the sensitive parts thereof. The chinband is forced upwardly and against the lower chin portion of the horse exerting pressure on the sensitive areas there. The cheekstraps are pulled downwardly by the rotating movement of the end eyelet causing pressure to be applied to the sensitive areas behind the ears of the horse and the cloverleaf sidepieces tend to have a torque motion that moves them inwardly against the inside of the jaws of the horse causing pressure to be applied to sensitive areas contained therein. In this manner the actions and performance of a horse can be controlled without exerting undue pressure and without causing physical damage to the horse.

The novel features of this invention both as to the manner of construction or organization as well as the operation will be better understood with reference to the following description and drawings. It is to be understood, however, that the description and drawings are for the purpose of illustration only and not intended to be a definition as to the scope of this invention.

DRAWINGS OF THE INVENTION

In the drawings:

FIG. 1 drawing of the invention mounted on the horses head;

FIG. 2 is a perspective view of the bridle showing the points of attachment of the noseband and chinband.

DETAILED DESCRIPTION

Figure 1:
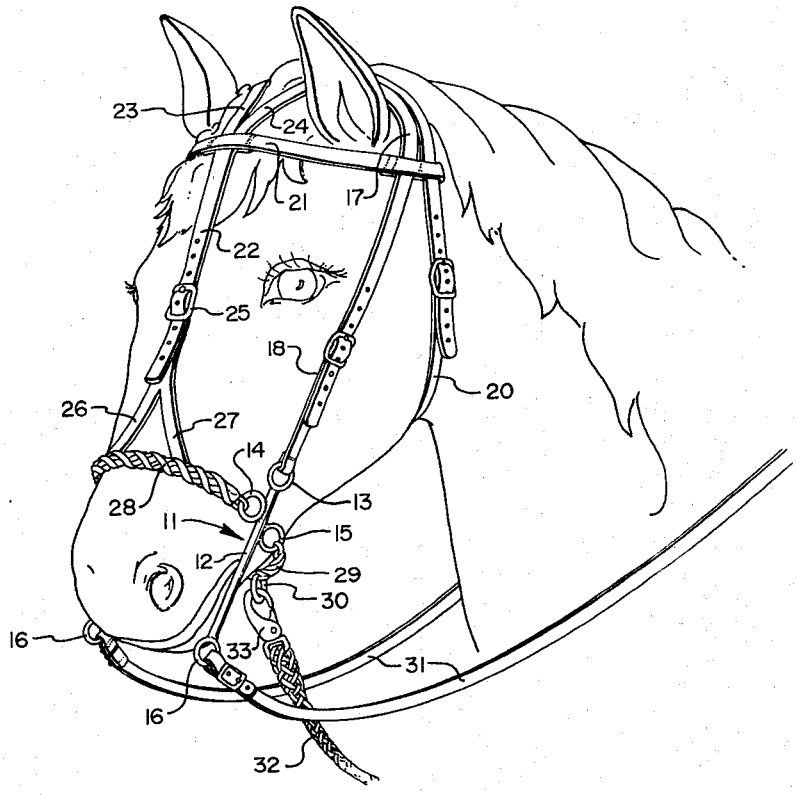
Figure 2:
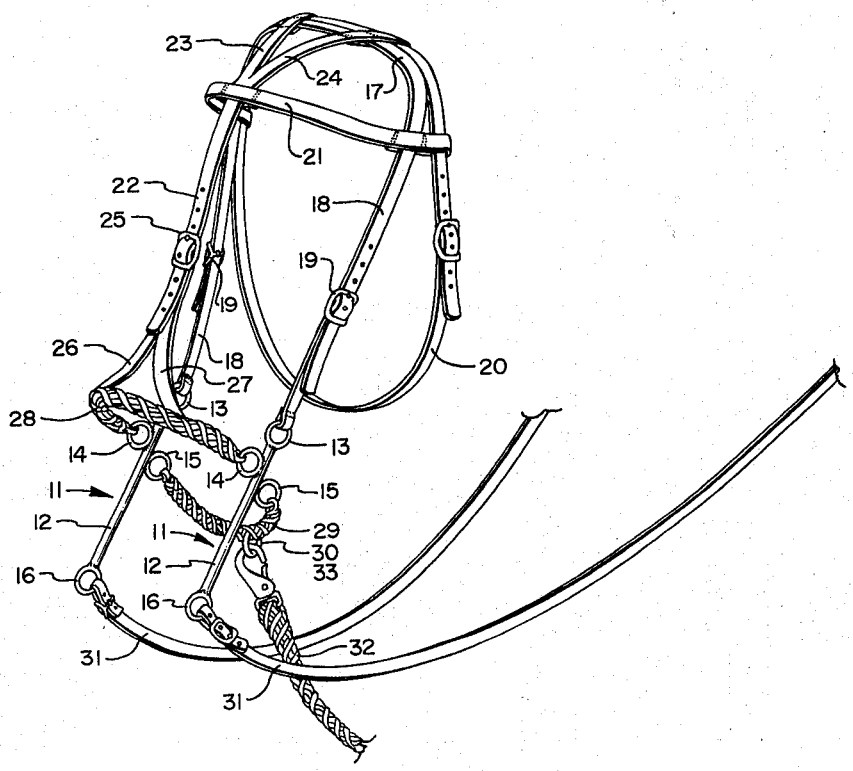

Referring now to the drawings:

There is shown in FIGS. 1 and 2 an operative embodiment of the present invention. The main operational component of the apparatus is the rigid cloverleaf sidepiece 11 which consists of a shaft 12 which is preferably cylindrical in shape but can be of any other desired configuration, i.e., square, octagonal, etc. and has at one end a cloverleaf configuration consisting of end eyelet 13 which may be in longitudinal alignment with shaft 12 or may be angled slightly outwardly therefrom. Attached to shaft 12 and near the end containing eyelet 13 are oppositely spaced eyelets extending perpendicularly from the shaft and in the same plane. Eyelet 14 which is the noseband eyelet is located just slightly closer the end eyelet than is eyelet 15 which is the chinband eyelet. At the other end of shaft 12 and in the same longitudinal plane is eyelet 16 to which the reins are attached. From the figures it can be seen that the supporting gear of the bridle consists of a headstall 17 running over the head of the horse behind the ears and terminating in adjustable cheekstraps 18 having adjustable means 19. The cheekstraps are attached on either side to the cloverleaf sidepiece by means of eyelet 13. Looped around the neck and throat of the horse is throatlatch 20 having an adjustable attachment. A browband 21 is provided having passageways in either end thereof through which the throatlatch and cheekpieces pass; also passing through the browband in the center portion thereof is centerpiece 22, the upper portion of which is divided into two sections 23 and 24 the end portions of which pass between the ears of the horse and are looped around and attached to each other to form a passageway through which headstall 17 and throatlatch 20 pass. The centerpiece is adjustable and has an adjustment buckle 25. The lower portion of centerpiece 22 may be divided into end sections 26 and 27 which are fixedly attached to noseband 28. Noseband 28 is preferably constructed of a velvet or other fabric covered chain and is attached at either end to eyelets 14 of the cloverleaf sidepieces. Extending around and under the jaws of the horse is chinband 29 which is fixedly attached at each end to eyelet 15 of the cloverleaf sidepiece. The chinband is preferably constructed of a fabric covered chain and attached to the center portion of said chinpiece is a rigid ring 30 which may be used for training or tie down purposes. Attached to the lower end of the cloverleaf sidepiece are reins 31 passing through eyelet 16. The reins may either be fixedly or detachably attached. When used for training purposes a training rope 32 having a swivel snap 33 is attached to the training ring 30.

In attaching the cloverleaf bitless bridle to the horse the centerpiece and cheekstraps are adjusted so that the noseband fits snugly over the horses nose and does not hang loose and droop down on the horses nostrils. The cloverleaf sidepieces 11 pull toward each other at the end the reins are attached to and almost touch when proper adjustment has been made.

The cloverleaf bridle as described is used much like a hackamore except that the combination of the cloverleaf gives added leverage power so that a light pull on the reins applies direct pressure on the nose, under the chin, behind the ears and also torques inwardly on the side of the jaws of the horse at the same time. The utilization of all four of these pressure points at the same instant makes it unnecessary to have a bit in the horses mouth cutting the tongue, chipping the teeth and causing other common bruises and cuts by jerking or by an inexperienced rider.

When using the training rope, attachment of the rope is made to training ring 30 and the horse is controlled by pulling the training rope causing the same pressure to be applied to the head of the horse as when the reins are pulled backward. From the figures it is evident that backward pressure may be applied simultaneously to the cloverleaf sidepiece via the reins or the training rope or when using the reins pressure may be applied to one sidepiece only as is necessary when turning the animal. The cloverleaf sidepiece is novel in that it will rotate about an imaginary axis located on the sidepiece at a point approximately between the areas where the oppositely extending noseband and chinband eyelets are connected to the sidepiece. Rotation about this axis is unique in that it causes pressure to be applied to at least four points on the horses head, i.e., behind the ears, over the nose, under the chin and inwardly on the jaws. Other prior art devices have required moving parts which rotate about a fixed axis and which do not simultaneously apply pressure as does the cloverleaf bridle combination.

Although the invention as has been described is deemed to be that which would form the preferred embodiment of the invention, it is recognized that departures may be made therefrom without departing from the scope of the invention which is not to be limited to the details disclosed, but to be accorded the full scope of the claims so as to include any and all equivalent devices and apparatus.

What is claimed is:

1. A bitless bridle for horses comprising in combination
   a. a rigid sidepiece consisting of a shaft, one end having a single eyelet extending longitudinally therefrom and the other end of the shaft having three eyelets in cloverleaf configuration, the end cloverleaf eyelet extending longitudinally therefrom and the other two cloverleaf eyelets being slightly offset and oppositely extending from each other along the shaft perpendicular to and in the same plane as the end eyelet;
   b. supporting headgear comprising a headstall having a throatlatch and a band extending from the top of the horses head behind the ears and terminating in cheekstraps, the ends of which are connected to the end cloverleaf eyelet;
   c. a noseband attached at each end to the perpendicularly extending cloverleaf eyelet closest the end cloverleaf eyelet;
   d. a chinband attached at each end to the oppositely extending cloverleaf eyelet;
   e. reins attached to the single eyelet at the end of the shaft opposite the cloverleaf eyelets;
   f. an adjustable centerpiece interconnecting said noseband and headstall.

2. A bitless bridle as claimed in claim 1 wherein the centerpiece is attached at one end through the noseband and at the other end to the headstall in the area between and behind the horses ears.

3. A bitless bridle according to claim 2 wherein the chinband additionally contains a ring in the center portion thereof for the attachment of a training rope or similar device.

4. A bitless bridle according to claim 2 wherein the supporting headgear additionally contains a browband having passageways at either end through which the headstall and throatlatch pass and through which the centerpiece passes in the central portion thereof.

5. A bitless bridle according to claim 4 wherein the rigid sidepiece has an axis of rotation such that when backward pressure is applied to the reins pressure is simultaneously applied to the horse by downward pressure of the noseband, upward pressure of the chinband, downward pressure behind the horses ears and inward pressure on the jaws of the horse by the cloverleaf sidepieces.

6. A bitless bridle according to claim 2 wherein the end cloverleaf eyelet is angled slightly outwardly from the longitudinal plane of the rigid sidepiece shaft.

* * * * *